US006007009A

United States Patent [19]

Sheridan et al.

[11] Patent Number: 6,007,009

[45] Date of Patent: Dec. 28, 1999

[54] BOWL ASSEMBLY FOR CONE CRUSHER

[75] Inventors: James A. Sheridan, Greendale; Karl W. Droese, Big Bend, both of Wis.

[73] Assignee: ANI Mineral Processing, Inc., Brookfield, Wis.

[21] Appl. No.: 09/172,955

[22] Filed: Oct. 14, 1998

[51] Int. Cl.[6] ..... B02C 2/00

[52] U.S. Cl. ..... 241/207

[58] Field of Search ..... 241/207–216, 241/286

[56] References Cited

U.S. PATENT DOCUMENTS

| | | | |
|---|---|---|---|
| 3,834,633 | 9/1974 | Dougall et al. | 241/295 |
| 4,215,826 | 8/1980 | Schafer | 241/207 |
| 4,717,084 | 1/1988 | Vendelin et al. | 241/207 |
| 5,540,393 | 7/1996 | Stafford et al. | 241/30 |
| 5,769,340 | 6/1998 | Jean | 241/207 |

*Primary Examiner*—Mark Rosenbaum
*Attorney, Agent, or Firm*—Michael Best & Friedrich LLP

[57] ABSTRACT

A cone crusher alternatively operable with either a first bowl liner or a second bowl liner, the crusher including a frame, a crusher head, a bowl supported by the frame, the bowl including a bowl liner mounting surface, a locking mechanism on the bowl and the bowl liner for alternatively fixing the first bowl liner and the second bowl liner to the bowl, the locking mechanism including at least one locking assembly including a wedge member, a first link, a lock pocket defined by the bowl and being adapted to receive the first link, a lock mount defined by the bowl and being adapted to receive the first link, the lock pocket and the lock mount being respectively located relative to the bowl liner mounting surface such that the locking assembly is engagable with the locking flange of the first bowl liner when received by the lock pocket and such that the locking assembly is engagable with the locking flange of the second bowl liner when received by the lock mount.

20 Claims, 8 Drawing Sheets

BOWL ASSEMBLY FOR CONE CRUSHER

FIELD OF THE INVENTION

The present invention generally relates to crushers and, more specifically, to cone crushers.

BACKGROUND OF THE INVENTION

Cone crushers typically include a frame supporting a crusher head and a mantle secured to the head. A bowl assembly including a bowl and bowl liner are supported by the frame so that an annular space is formed between the bowl liner and the mantle. In operation, larger particles are fed into the annular space between the bowl liner and the mantle. The head, and the mantle mounted on the head, gyrate about an axis, causing the annular space to vary between a minimum and a maximum distance. As the distance between the mantle and the bowl liner varies, the larger particles are impacted and compressed between the mantle and the bowl liner. Through a series of blows, the particles are crushed and reduced to the desired product size, and then discharged from between the mantle and the bowl liner.

Cone crushers are operable to reduce large aggregate into medium sized aggregate particles, and to further reduce medium sized particles to small sized aggregate particles. Cone crushers can be adjusted in set up to provide the desired output for a given size feed. One set up parameter that can be varied is the size and configuration of the bowl liner used to crush the aggregate. The use of different bowl liners for different desired aggregate outputs is generally known. It is also known to provide a cone crusher with a locking mechanism to fix a bowl liner to the associated bowl.

SUMMARY OF THE INVENTION

One of the problems with known bowl liner locking mechanisms is that the mechanisms are not fully capable of accommodating variations in bowl liner configurations due to manufacturing tolerances, imperfections in materials, etc . . . . Such variations have heretofore been addressed by the use of shims and the like placed between the components of the locking mechanisms and the bowl liner. Alternatively, this problem can be addressed by manufacturing and assembling bowl liners with a high degree of precision. Such precision manufacturing and assembly techniques required in prior cone crushers increases the overall cost of known cone crushers.

Another problem associated with known crusher designs arises when a first bowl assembly which includes a first bowl liner needs to be modified so as to include a second bowl liner that is of different size than the first bowl liner. An example of this problem is the use of the crusher to perform a secondary crushing operation using a secondary bowl liner and to subsequently perform a tertiary crushing stage with a tertiary bowl liner that is sized differently from the secondary bowl liner. In such a case, it is often necessary to provide a second bowl that is appropriately configured and sized to cooperate with the second bowl liner. This thus requires an inventory of multiple bowls to be maintained, which increases the cost of operating known crushers.

To overcome this problem associated with existing cone crushers, the present invention provides a cone crusher which is adaptable to be alternatively operable with bowl liners of differing sizes and configurations. Also, the present invention provides a cone crusher with a locking mechanism that is independently adjustable between a bowl and a bowl liner so as to have the capacity to accommodate slight variations in bowl liner configuration from nominal design dimensions. The invention thus provides a cone crusher that has the capacity to use bowl liners of varying sizes and configurations without the need for prior precision manufacturing and assembly techniques and without the need for shims and the like.

In one embodiment, the invention provides a cone crusher with an adjustable bowl liner locking assembly for fixing a bowl liner to a bowl.

In another embodiment, the invention provides a cone crusher adapted to be alternatively operable with either a first bowl liner or a second bowl liner. In this embodiment, the invention provides a crusher including an adjustable locking means for alternatively fixing either the first bowl liner or the second bowl liner to the bowl.

In another embodiment, the invention provides a cone crusher adapted to be alternatively operable with either a first bowl liner or a second bowl liner, a locking mechanism for fixing the first and second bowl liners in place, and a feed cone adapter which can be used in conjunction with either the first bowl liner or the second bowl liner. This feature of the invention is advantageous by the elimination of an inventory of multiple feed cone adapters used with different sized bowl liners.

More particularly, the invention provides a cone crusher including a frame and a crusher head supported by the frame. The cone crusher also includes a bowl supported by the frame in spaced relation to the crusher head and a bowl liner having an inlet end and a locking flange. The cone crusher also includes a bowl liner locking assembly for fixing the bowl liner to the bowl in a surrounding relation to the crusher head. The locking assembly includes a wedge member providing a locking surface engagable with the locking flange, and a first link connected to the wedge and engaged with the bowl, and a second link connected to the wedge. The first and second links each have adjustable lengths. By adjusting the lengths of the first and second links, the wedge can be positioned to engage the locking flange of the bowl liner and to accommodate deviations in the exact position of the locking flange from the nominal design of the bowl liner.

The cone crusher is adapted to be alternatively operable with either a first bowl liner or a second bowl liner, the first and second bowl liners each having an inlet end and a locking flange extending therefrom, a bowl mounting surface and a respective predetermined length extending between the inlet end and the bowl mounting surface.

The crusher includes a bowl having a bowl liner mounting surface. The bowl also includes a mounting pocket located a predetermined distance from the bowl liner mounting surface. The bowl also includes a lock mount located at a second predetermined distance from the bowl liner mounting surface. The first link of the locking assembly is adapted to be received by either the lock pocket or the lock mount.

When the first link is in the mounting pocket, the locking assembly is mounted on the bowl in position to fix the first bowl liner to the bowl. Alternatively, when the first link is in the lock mount, the locking mechanism is mounted on the bowl in a position for fixing the second bowl liner to the bowl. Thus, the crusher is capable of using a first bowl liner, such as a secondary crushing stage bowl liner with the locking mechanism in a first position on the bowl, and also a second bowl liner, such as a tertiary stage bowl liner, with the same locking mechanism located in a second mounting position.

One feature of the present invention is that by providing an independent fully adjustable locking assembly to secure a bowl liner to a bowl, the cone crusher affords a greater degree of imprecision in the manufacture of both the cone crusher and the bowl liners.

Another feature of the invention is the provision of a crusher that can be used with multiple sizes of bowl liners with a single bowl and locking mechanism.

Another feature of the invention is that the cone crusher includes a single feed cone adapter that can be used in conjunction with different sizes of bowl liners. This eliminates the need for having multiple feed cone adapters for use with different sizes of bowl liners.

Other features and advantages of the invention will become apparent to those skilled in the art upon review of the following detailed description, claims and drawings.

Figure 1:
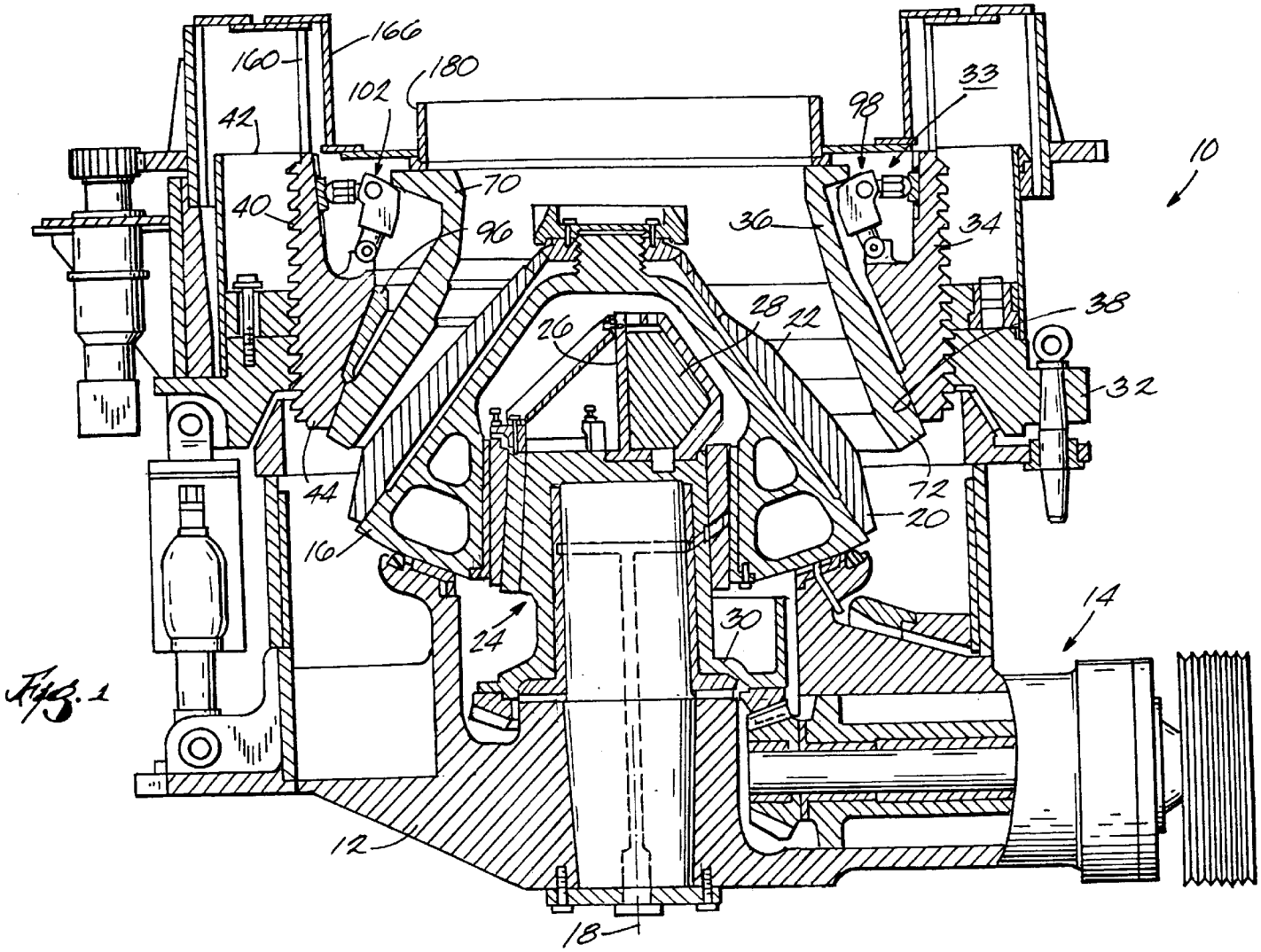
FIG. 1 is a cross-sectional view of a cone crusher embodying the present invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENTS

The drawings illustrate a cone crusher 10 embodying the invention. As shown in FIG. 1, the cone crusher 10 includes a frame 12, a drive system 14 (a portion of which is shown), and a crusher head 16 supported by the frame 12 for gyration about a central crusher axis 18. The head 16 is driven by the drive system 14 for gyration or eccentric rotation about the axis 18. A mantle 20 is mounted on the outer surface of the head 16 and provides a generally frustoconical crushing surface 22.

The cone crusher 10 also includes an eccentric assembly 24 which operates to laterally locate the head 16 and which determines the eccentricity of the gyration of the head 16. While various suitable constructions of the eccentric assembly 24 can be used successfully, the preferred arrangement and construction of the eccentric assembly 24 provides the cone crusher 10 with a mechanism for varying the throw of the crusher 10. The eccentric assembly 24 is fully disclosed in U.S. application Ser. No. 08/173,037, filed Oct. 14, 1998 and titled "VARIABLE THROW ECCENTRIC CONE CRUSHER AND METHOD FOR OPERATING THE SAME"; which is incorporated herein by reference.

The cone crusher 10 also includes a counterweight assembly 26 to counteract the forces resulting from the gyration of the head 16 and the eccentric assembly 24. While various suitable constructions of the counter-weight assembly 26 can be used successfully, the preferred arrangement and construction of the counter-weight assembly 26 includes a first counterweight 28 and a second counterweight 30. The arrangement and construction of the counterweight assembly 26 is fully disclosed in U.S. application Ser. No. 08/172,987, filed Oct. 14, 1998 and titled "ECCENTRIC CONE CRUSHER HAVING MULTIPLE COUNTERWEIGHTS", which is incorporated herein by reference.

The cone crusher 10 also includes an adjustment ring 32 which is supported on the frame 12 and which supports a bowl assembly 33. The bowl assembly 33 includes a bowl 34 and a bowl liner 36, such as bowl liner 36A shown in FIG. 4 or alternatively bowl liner 36B shown in FIG. 5. The bowl assembly 33 is moveable relative to the adjustment ring 32 along the axis 18.

The bowl 34 is generally ring-shaped and surrounds the bowl liner 36. The bowl 34 includes an inner surface 38, an outer surface 40, an upper face 42, and a lower face 44. The outer surface 40 is threaded and engages the adjustment ring 32. The inner surface 38 is generally configured to receive the bowl liner 36 and to accept crushing forces transferred from the bowl liner 36 to the bowl 34. The inner surface 38 includes (FIGS. 7 and 8) a generally cylindrical side wall 48 which extends downward from the upper face 42. For reasons discussed below, the side wall 48 has therein a plurality of vertically extending grooves or slots 50 which are circumferentially spaced apart about side wall 48.

The inner surface 38 of the bowl 34 also includes an inwardly extending shelf 52 that is located intermediate the upper face 42 and lower face 44. The shelf 52 faces the upper portion of the bowl 34 and is located adjacent the lower extent of the side wall 48. In general, the shelf 52 defines the most narrow constriction or opening of the interior space defined by the bowl 34. This opening or throat limits the size of the bowl liner 36 that can be housed by the bowl 34 because the upper portion of the bowl liner 36 must be able to pass by the shelf 52 during assembly of the bowl 34 and bowl liner 36.

The inner surface 38 of the bowl 34 also includes (FIGS. 7 and 8) a frustoconical portion 66 which tapers radially outwardly from below the shelf 52 toward the lower face 44. The inner surface 38 of the bowl 34 also includes a bowl liner mounting surface 68 which is located adjacent the lower face 44 and immediately below the frustoconical portion 66. The bowl liner mounting surface 68 mates with a portion of the bowl liner 36 supported by the bowl assembly 33 in a manner discussed below.

Figure 9:
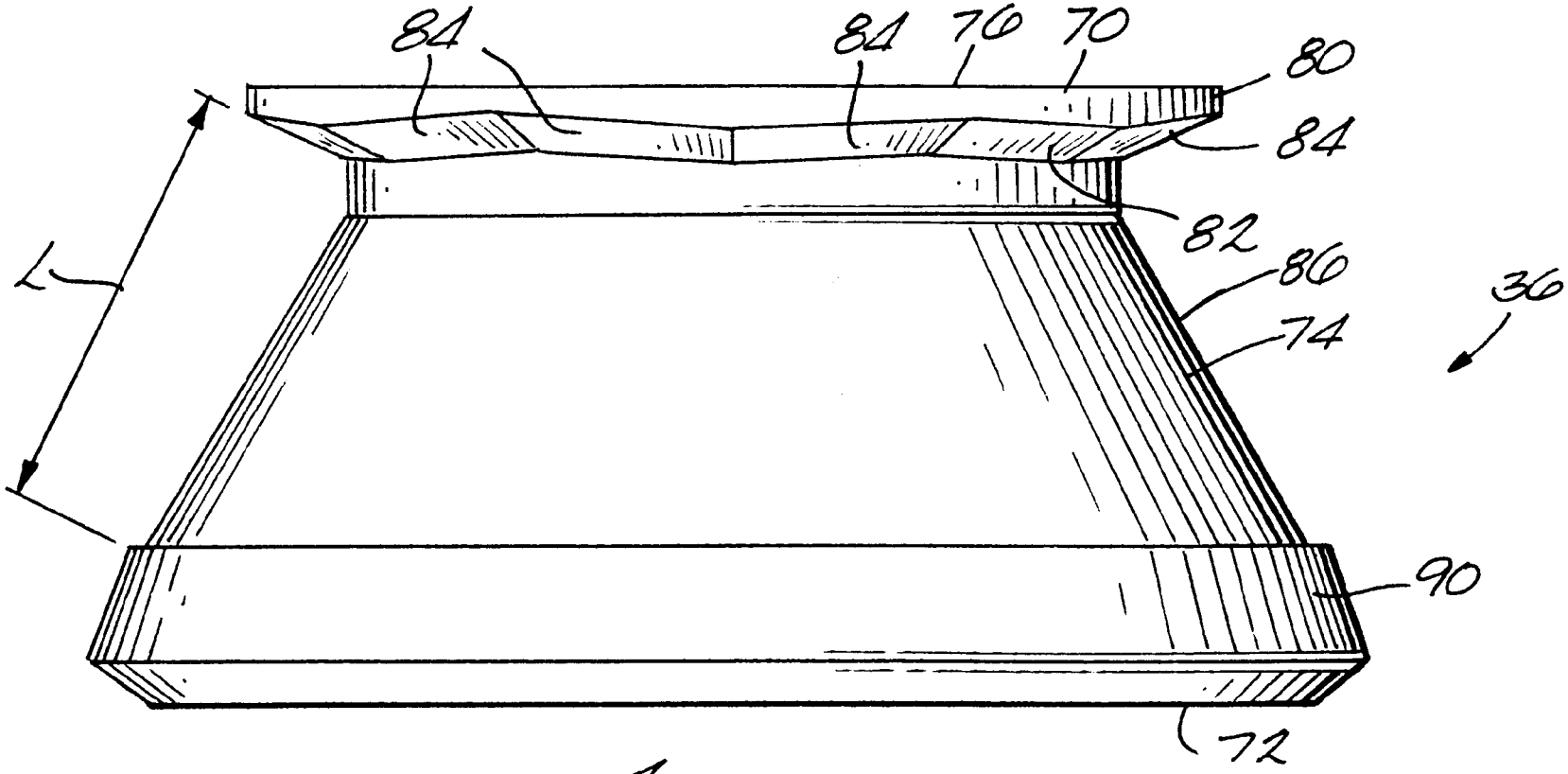
FIG. 9 is a front view showing a portion of the crusher shown in FIG. 1.

FIG. 9 illustrates a typical bowl liner 36 included in the bowl assembly 33. The bowl liner 36 has opposite upper and lower ends 70, 72 and a generally frustoconical, hollow body 74 extending between the upper and lower ends 70, 72. The upper end 70 of the liner 36 provides an annular, axially facing feed cone sealing surface 76 and defines an inlet 78 opening into the interior of the body 74. The bowl liner 36 also has a locking flange 80 that extends radially from the upper end 70 adjacent the feed cone sealing surface 76. The diameter of the locking flange 80 is smaller than the size of the opening defined by the shelf 52 on the bowl 34 so that the upper portion of the bowl liner 36 can pass by the shelf 52.

As shown in FIG. 9, the underside 82 of the locking flange 80 provides a wedging surface 84 which is used to fix the bowl liner 36 in position relative to the bowl 34. For reasons discussed below, the bowl liner 36 is ramped or scalloped to provide a plurality of wedging surfaces 84.

Figure 4:
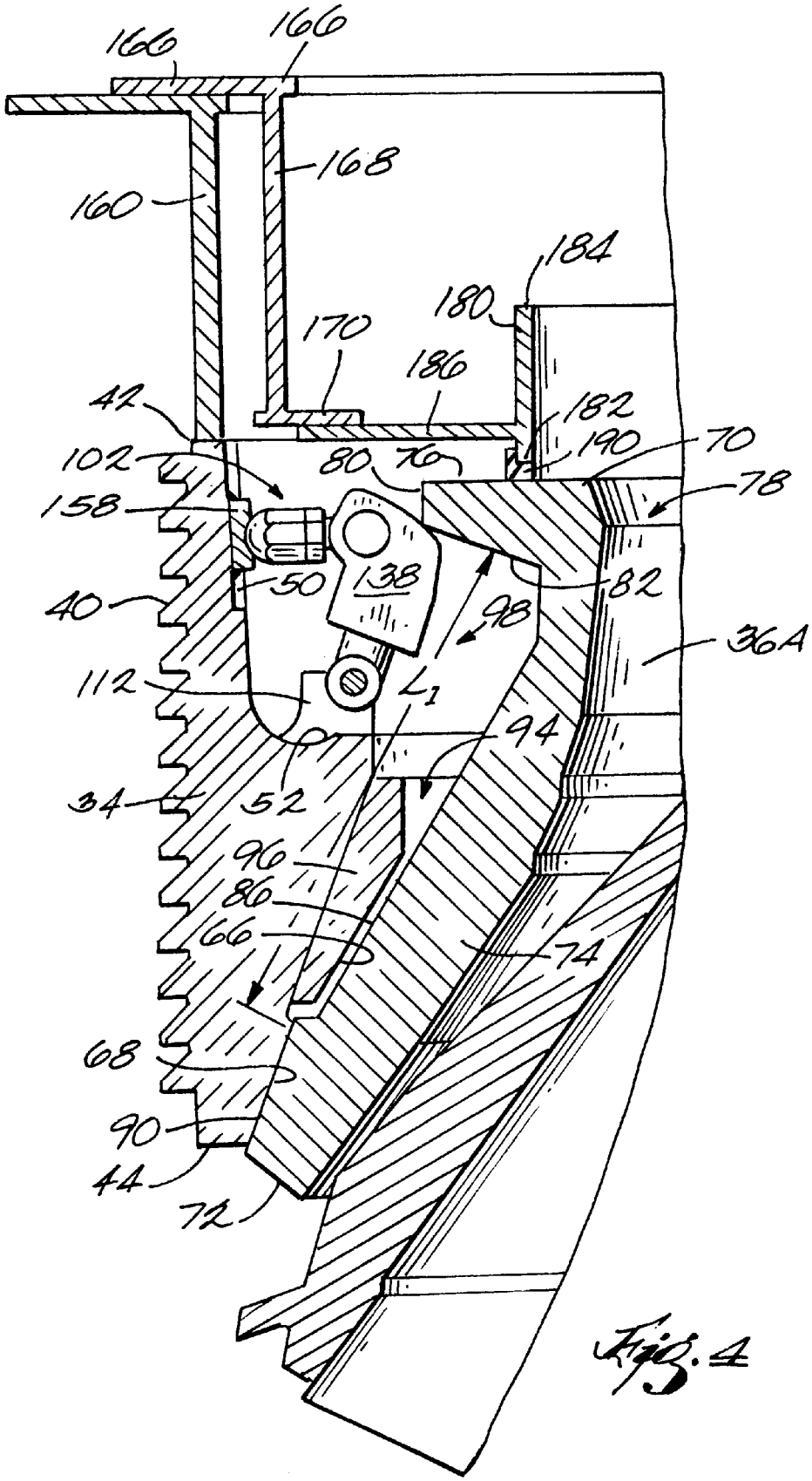
FIG. 4 is an enlarged view of a portion of the cone crusher illustrated in FIG. 1 showing the crusher in a first position.
Figure 5:
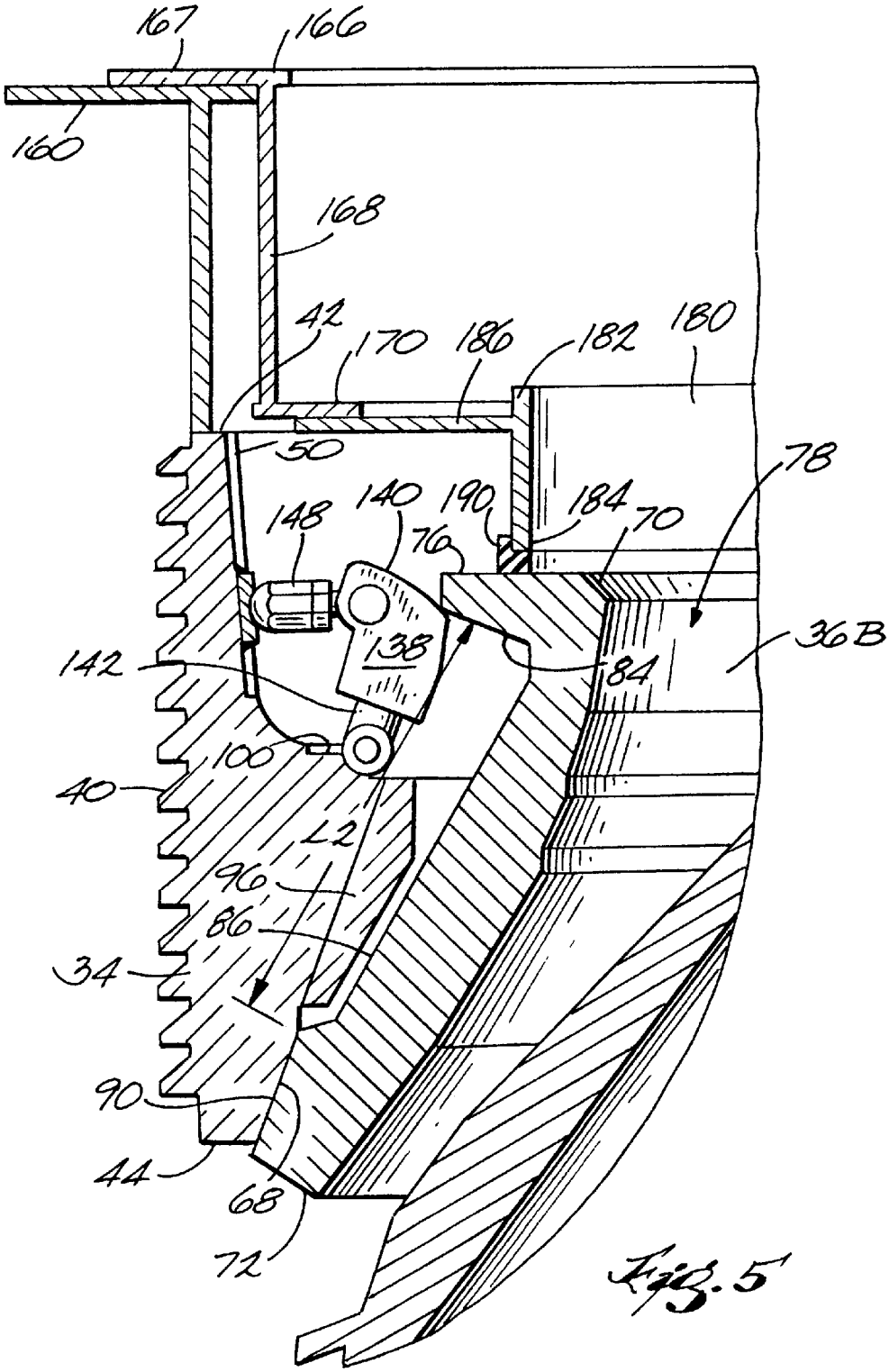
FIG. 5 is a view similar to FIG. 4 showing the cone crusher in a second position.
Figure 6:
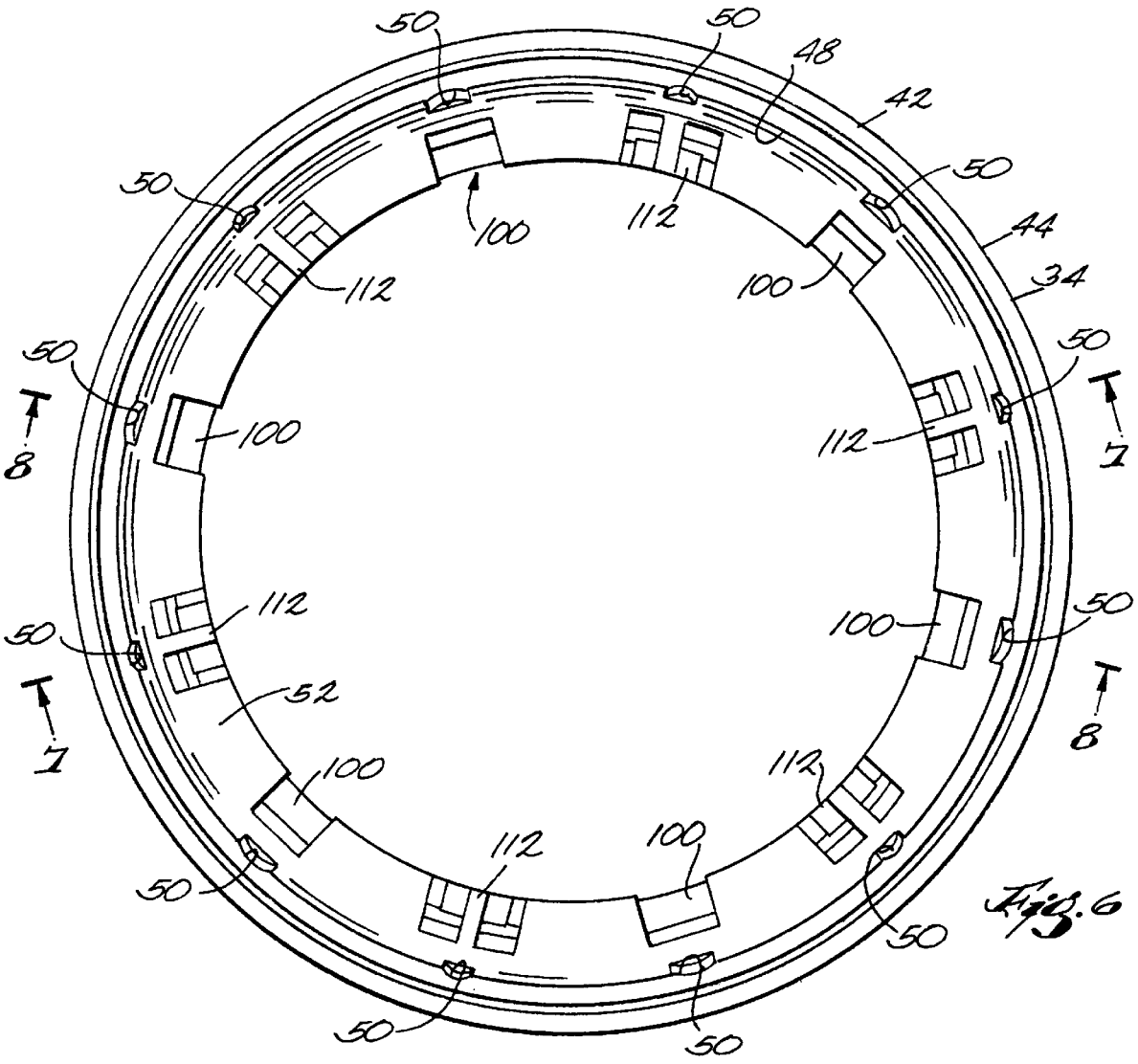
FIG. 6 is a top view of a portion of the crusher shown in FIG. 1.

The outer surface 86 of the bowl liner 36 extends between the ends 70, 72 and provides a bowl mounting surface 90 located at a predetermined distance L generally from the inlet end 70, and specifically from the underside of the locking flange 82. The bowl mounting surface 90 extends around the entire lower end 72 of the bowl liner 36. As discussed in detail below, and as shown in FIGS. 4 and 5, when the bowl liner 36 is mounted on the bowl 34, the bowl mounting surface 90 mates with the bowl liner mounting surface 68 to form a cavity 94 between the outer surface 86 of the bowl liner 36 and the frustoconical surface 66 of the bowl 34.

The cone crusher 10 also includes a filler ring 96 which occupies the cavity 94 and bolsters the bowl liner 36 so that crushing forces are transferred to the bowl 34.

As mentioned above, the cone crusher 10 is adapted to be alternatively operable with either a first bowl liner or a second bowl liner. This is desirable, for example, in crushing applications wherein the crusher 10 is used alternatively to perform a secondary crushing stage and a tertiary crushing stage. In the illustrated embodiment, the crusher 10 is capable of using a secondary stage bowl liner, shown in FIG. 4 as bowl liner 36A, as well as a tertiary stage bowl liner which is shown in FIG. 5 as bowl liner 36B and which may differ in size and configuration from the secondary bowl liner 36A.

More particularly, the liners 36A and 36B share a common overall shape, but may have different dimensions and surface angles to provide different crushing effects. Such variations are known in the art. of particular relevance to the use of the bowl liners 36A and 36B as components in the bowl assembly 33, however, are the respective overall lengths L1 and L2 of the bowl liners 36A, 36B and how the lengths L1, L2 of the liners 36A, 36B result in different alignments with the bowl 34. Referring particularly to FIG. 9, a bowl liner 36 has a predetermined length L extending between the bowl mounting surface and the underside of the locking flange. In the case of bowl liner 36A shown in FIG. 4, the length L1 differs from (FIG. 5) the length L2 of the liner 36B.

In the context of the bowl assembly 33, the bowl liner mounting surface 68 at the lower end of the bowl 34 engages and mates with the bowl mounting surface 90 on the associated bowl liner 36 without regard to the overall length L of the particular bowl liner 36 used in the bowl assembly 33. As a consequence, the differences in length L among bowl liners 36 result in the upper portions of the bowl liners 36 being located differently relative to the upper portion of the associated bowl 34. For example, in FIG. 4, the bowl liner 36A is positioned on bowl 34 and the locking flange 80 is located above the shelf 52. In contrast, the locking flange 80 of bowl liner 36B (shown in FIG. 5) when mounted on the bowl 34 extends above the shelf 52 but at a lesser degree. Thus, the respective wedging surfaces 84 of the bowl liners 36A and 36B are aligned differently with respect to the bowl 34 when each is made a component of the bowl assembly 33.

In order to provide a crusher adapted to be alternatively operable with either a first bowl liner having a first predetermined length or a second bowl liner having a predetermined length different from the first length, such as with bowl liners 36A and 36B, the crusher 10 also includes locking means 98 for alternatively fixing the first bowl liner 36A and the second bowl liner 36B to the bowl 34. While various suitable constructions of the locking means 98 can be successfully used, in the illustrated embodiment, the locking means 98 includes a plurality of lock pockets 100 formed in the bowl 34. As explained below, the lock pockets 100 are positioned for receiving respective locking assemblies 102 when the second bowl liner 36B is used as a component of the bowl assembly 33.

Figure 7:
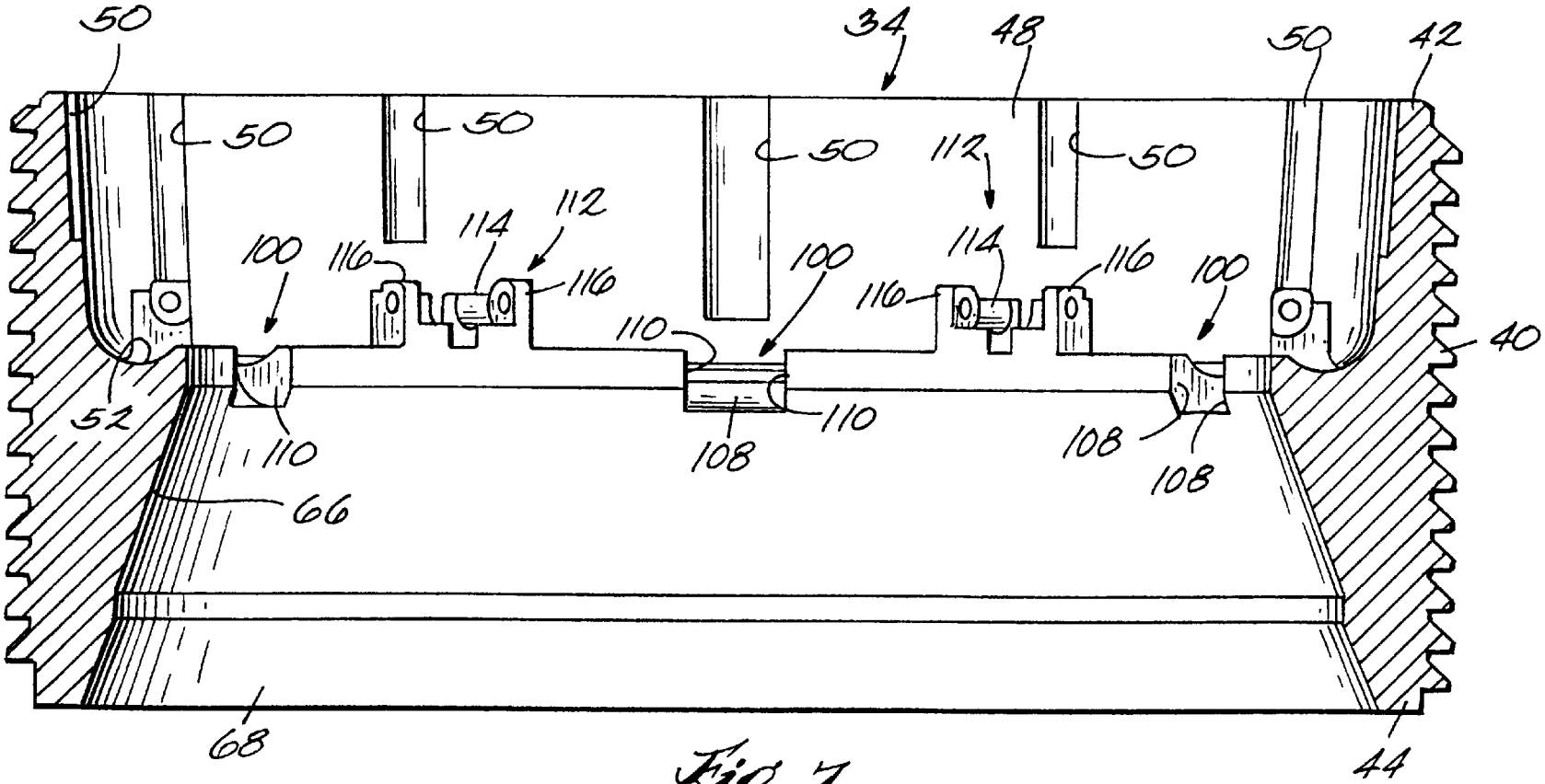
FIG. 7 is a partial cross-sectional view taken along line 7—7 of FIG. 6.

More particularly, and as best shown in FIG. 7, the plurality of lock pockets 100 are spaced apart and circumferentially positioned around the annular shelf 52 on the bowl 34. Each lock pocket 100 is a recess in the shelf 52 and includes a cylindrical mounting surface 108 and a pair of spaced-apart side walls 110.

The locking means 98 also includes a plurality of lock mounts 112 formed in the bowl 34 for receiving respective locking assemblies. As explained below, the lock mounts 112 are positioned for receiving respective locking assemblies 102 when the first bowl liner 36A is used as a component of the bowl assembly 33. The lock mounts 112 are also spaced apart and circumferentially positioned around the annular shelf 52 on the bowl 34 in alternating relation to the lock pockets 100. Each lock mount 112 extends upwardly from the shelf 52, and therefore is located closer to the upper face 42 of the bowl 34 than the shelf 52 and lock pockets 100. In other words, each lock mount 112 is located a greater distance from the bowl liner mounting surface 68 than a corresponding lock pocket 100.

Figure 8:
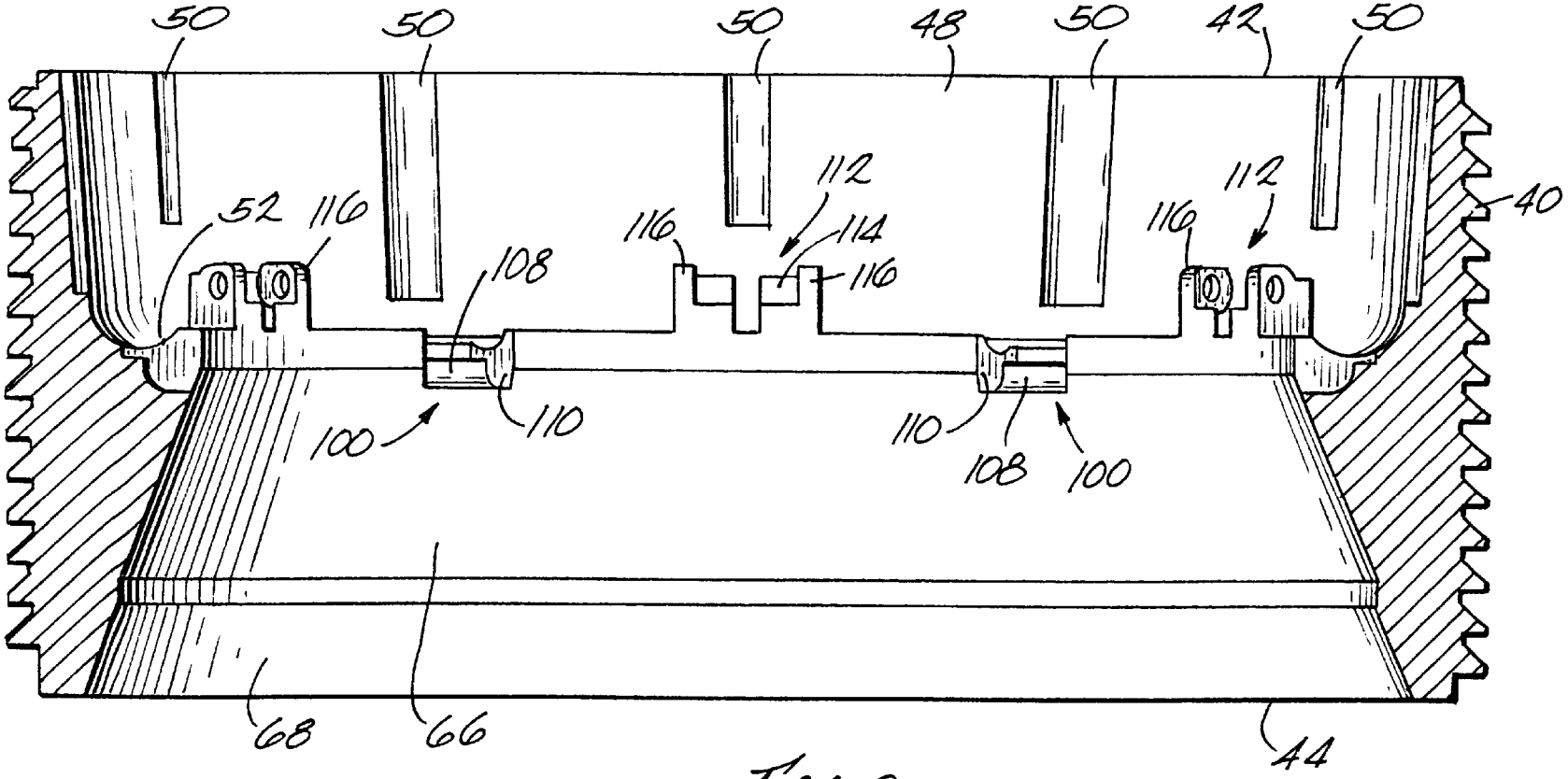
FIG. 8 is a partial cross-sectional view taken along line 8—8 of FIG. 6.

Each lock mount 112 provides a cylindrical mounting surface 114 which is spaced above the upper surface of the shelf 52. Each mounting surface 114 is bounded by a pair of spaced-apart side ears 116. The cylindrical mounting surface 114 and associated side ears 116 define therebetween a recess that has configuration similar to that of the recess defined by each of the pockets 100. As shown in FIGS. 7 and 8, the side ears 116 each have bores extending therethrough, thus affording use of the ears 116 as lifting lugs for handling the bowl 34.

While any number of lock pockets 110 and lock mounts 112 can be used for the particular bowl assembly 33 needed for a crusher 10, in the illustrated embodiment of the crusher, the locking means provides a set of six lock pockets 100 and a set of six lock mounts 112, alternately arranged in spaced relation about the circumference of the annular shelf 52.

The locking means 98 also includes (FIGS. 2 and 3) a plurality of locking assemblies 102 which are mounted on the bowl 34 and which engage the bowl liner 36 and the bowl 34 to fix the bowl liner 36 to the bowl 34 in surrounding relation to the crusher head 16. Each of the bowl liner locking assemblies 102 are identical, and one will be described in detail.

Each bowl liner locking assembly 102 includes (FIG. 2) a wedge member 138 having a locking surface 140 and having extending therein a pair of threaded bores. Each locking assembly 102 also includes a first link 142 which is connected to the wedge member 138. The first link 142 may be referred to as a T-bolt. The T-bolt 142 is of a "T" shape and includes a threaded extension 144 which is threaded into one of the bores in the wedge member 138. The T-bolt 142 also includes a generally cylindrical base section or mounting piece 146.

Each bowl liner locking assembly 102 also includes a second link 148 which is connected to the wedge member 138. The second link 148 may be referred to as a T-pin or mounting pin. The T-pin 148 is of a "T" shape and includes a threaded extension 150 and a handle portion 152. The handle portion 152 mates with the wedge member 138 such that the T-pin 148 is pivotally connected to the wedge member 138. A spherical nut 154 and a jam nut 156 are positioned on the threaded extension portion 150 of T-pin 148. A locking washer 158 engages spherical nut 154 when the cone crusher 10 is assembled.

FIG. 4 shows a locking assembly 102 fixing bowl liner 36A to bowl 34. The cylindrical base 146 of first link 142 is situated in the lock mount 112 and supports the wedge member 138 in position under the locking flange of the bowl liner 36A. The second link extends horizontally from the wedge member toward the slot 50. A locking washer 158 overlays slot 50 and provides a seat for receiving the rounded end of the spherical nut 154. Lock washer 158 may be tack welded into position. It should be noted that locking washer 158 and slot 50 may be replaced with any suitable means, such as, for example, appropriately arranged dimples or recesses formed in wall 48.

Because of the complementary shapes of the mounting piece 146 and mounting surface 114, the first link 142 is pivotable with respect to the receiving lock mount 112. The first link 142 and second link 148 are positioned so that the locking surface 140 of wedge member 138 engages the locking flange 82 of bowl liner 36. This engagement tends to lift the bowl liner and pull the bowl mounting surface at the lower end of the bowl liner 36A into engagement with the bowl liner mounting surface of the bowl 34. As noted, the underside of the locking flange 82 is preferably ramped so that the wedge member 138 is seated on a wedging surface to more securely engage the locking flange and so as to prevent axial and twisting movement of the bowl liner 36 relative to the bowl 34 during crusher operations.

FIG. 5 shows a locking assembly 102 fixing the bowl liner 36B to the bowl 34. In this arrangement the first link occupies the recess defined by a lock pocket, with the result being that the wedge member is held in a position lower than when the locking assemblies are in the lock mounts. When the locking assemblies are in the lock pockets, the locking assemblies are positioned to support a bowl liner having a length L2, such as bowl liner 36B, which is shorter than the length L1 of bowl liner 36A.

When the lock assembly is in a lock pocket, the second link 148 remains engaged with a slot 50, but at a position lower than when bowl liner 36A is used. The first and second links 142, 144 engage and support the locking flange of bowl liner 36B so that the bowl liner mounting surface and the bowl mounting surface are engaged. Thus, the locking means provides a single locking mechanism 98 to fix the bowl liners 36A and 36B in position relative to the crusher head and mantle 20, so that the crusher 10 defines an annular space through which aggregate passes.

Figure 2:
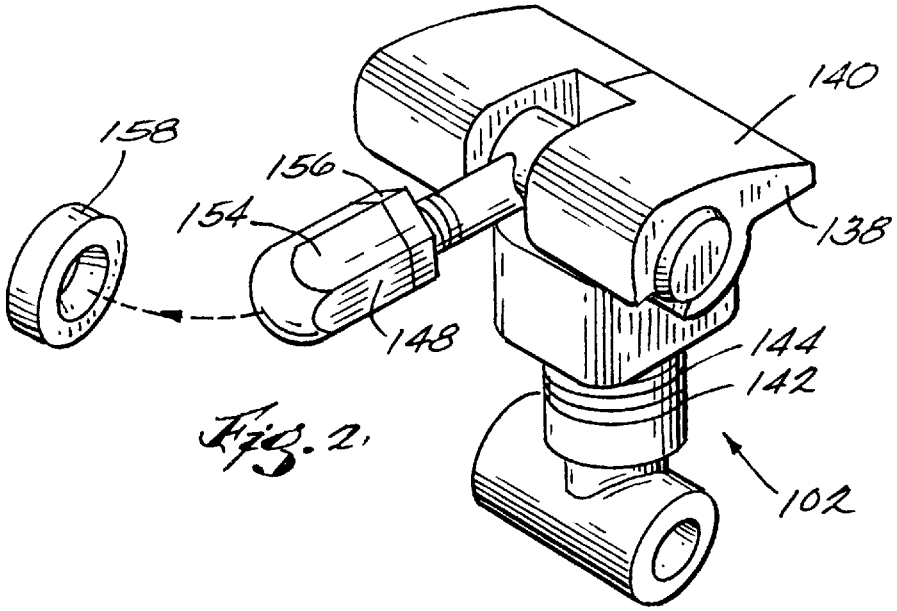
FIG. 2 is a perspective view of a portion of the cone crusher shown in FIG. 1.
Figure 3:
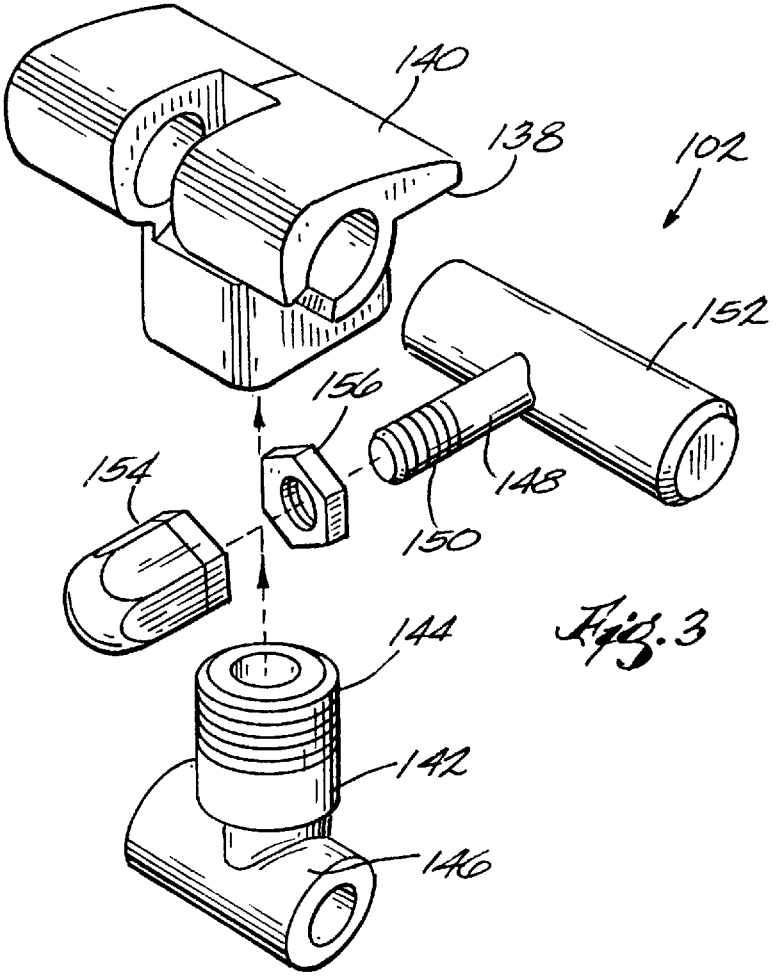
FIG. 3 is an exploded perspective view of the portion shown in FIG. 2.

The locking means 98 is also adjustable to accommodate deviations in the size and configuration of the bowl liners 36A, 36B from their nominal design dimensions. With reference to FIGS. 2 and 5, the locking means 98 is independently adjustable through adjustment of the length(s) of the first link 142 and/or the second link 148. The wedge member 138 may be horizontally translated as the as the relative to the bowl 34 as the T-pin 148 is threaded in or out with respect the wedge member 138 and the spherical nut 154. The wedge member 138 may be vertically translated relative to the bowl as the T-bolt 142 is threaded in or out of the wedge member 138. As a result, the camming action of the locking surface 140 can be adjusted by lengthening or shortening the length of links to assure secure engagement of the bowl liner 36 and the bowl 34.

With reference to FIGS. 1, 4 and 5, the bowl assembly 33 also includes an upper bowl ring weldment 160 which is fixed, typically by welding, to the upper face 42 of bowl 34. The weldment 160 extends above the upper face 42 of the bowl 34. The crusher 10 also includes a feed cone 166 located concentrically within the bowl weldment 160 and through which aggregate material is fed into the crusher 10. The feed cone 166 includes a cylindrical wall 168 having upper and lower ends. The feed cone 166 also includes a locking flange 167 which extends radially outward from the upper end of wall 168 and which overlays the top of the bowl weldment 160 to support the feed cone 166 in position above the bowl liner inlet 78. The feed cone 166 also includes a lower flange 170 which extends radially inward from the bottom of wall 168.

The crusher 10 also includes (FIGS. 4 and 5) a tubular feed cone adapter 180 which is concentrically arranged within the feed cone 166. The feed cone adapter 180 overlaps the flange 170 of the feed cone 166 and sealingly engages the inlet 78 of bowl liner 36 to direct particulates fed into the crusher 10 from the feed cone 166 into the space between the bowl liner 36 and mantle 20. The feed cone adapter 180 can be used in a first orientation, shown in FIG. 4, to sealingly mate with the upper end 70 of the bowl liner 36A, and can be alternatively inverted into a second position, shown in FIG. 5, to sealingly mate with the upper end 70 of the bowl liner 36B. These alternative orientations of the feed cone adapter 180 are needed because of the variation in respective positions of the upper end 70 of the bowl liners 36A and 36B due to the differences in their respective lengths L1 and L2.

More particularly, the feed cone adapter 180 has an elongated tube having the opposite ends 182, 184 and a flange 186 extending radially from the tube. The flange 186 is located intermediate the opposite ends 182, 184 so that the ends 182, 184 are spaced an unequal distance from the flange 186. When the feed cone adapter 180 is in the first position shown in FIG. 4, a sufficient length of the tube extends toward the inlet 78 of bowl liner 36A and one of the opposite ends 182 engages a feed cone adapter seal 190 located on the feed cone sealing surface 76 of the bowl liner 36A. The remainder of the tube extends above the flange 186 into the feed cone 166. When the feed cone adapter 180 is inverted, as shown in FIG. 5, a sufficient length of the tube extends toward the inlet 78 of bowl liner 36B and the other of the opposite ends 184 engages the feed cone adapter seal 190 located on the feed cone sealing surface 76 of the bowl liner 36B.

Various features of the invention are set forth in the following claims.

What is claimed is:

1. A cone crusher comprising:

a frame;

a crusher head supported by said frame for gyration about an axis;

a bowl supported by said frame in spaced relation to said crusher head;

a generally cylindrical bowl liner having an inlet end and a locking flange extending from said inlet end; and a bowl liner locking assembly for fixing said bowl liner to said bowl in a surrounding relation to said crusher head, said assembly including a wedge member providing a locking surface engagable with said locking flange, a first link connected to the wedge and engaged with said bowl, said first link having an adjustable length, and a second link connected to the wedge and engaged with the bowl, said second link having an adjustable length.

2. A cone crusher according to claim 1, wherein said first link is pivotable with respect to said bowl.

3. A cone crusher according to claim 1, wherein said second link is pivotable with respect to said bowl.

4. A cone crusher according to claim 1, wherein said bowl includes a recess and, wherein said first link includes a mounting piece such that said mounting piece is locatable in said recess.

5. A cone crusher according to claim 4, wherein said bowl includes a second recess adapted to receive said mounting piece of said first link such that when said mounting piece is located in said first recess, said bowl liner is fixed to said bowl in one position, and such that when said mounting piece is located in said second recess, said bowl liner is fixed to said bowl in another position.

6. A cone crusher adapted to be alternatively operable with either a first bowl liner or a second bowl liner, the first and second bowl liners each having an inlet end and a locking flange extending from the inlet end, and a bowl mounting surface, the first bowl liner having a first predetermined length extending between its inlet end and its bowl mounting surface, the second bowl liner having a second predetermined length extending between its inlet end and its bowl mounting surface, said crusher comprising:

a frame;

a crusher head supported by said frame for gyration about an axis;

a bowl supported by said frame in spaced relation to said crusher head, said bowl including a bowl liner mounting surface, a cylindrical wall and an annular flange extending from said cylindrical wall; and locking means for alternatively fixing the first bowl liner and the second bowl liner to said bowl, said locking means including at least one locking assembly including a wedge member, a first link connected to said wedge member and having a mounting piece, a lock pocket defined by said annular flange and also being adapted to receive said mounting piece of said first link, a lock mount defined by said annular flange and also being adapted to receive said mounting piece of said first link, said lock pocket and said lock mount being respectively located relative to said bowl liner mounting surface such that said wedge member is engagable with the locking flange of the first bowl liner when said mounting piece is located in said lock pocket and such that said wedge member is engageable with the locking flange of the second bowl liner when said mounting piece is located in said lock mount.

7. A cone crusher according to claim 6, wherein said first link has an adjustable length.

8. A cone crusher according to claim 6, wherein said first link is pivotable with respect to said bowl.

9. A cone crusher according to claim 6, further comprising a second link connected to said wedge member and engageable with said bowl.

10. A cone crusher according to claim 9, wherein said second link has an adjustable length.

11. A cone crusher according to claim 9, wherein said second link is pivotable with respect to said bowl.

12. A cone crusher adapted to be alternatively operable with either a first bowl liner or a second bowl liner, the first and second bowl liners each having an inlet end and a locking flange extending from the inlet end, and a bowl mounting surface, the first bowl liner having a first predetermined length extending between its inlet end and its bowl mounting surface, the second bowl liner having a second predetermined length extending between its inlet end and its bowl mounting surface, said crusher comprising:

a bowl assembly including a bowl having a bowl liner mounting surface, a cylindrical wall and an annular flange extending from said cylindrical wall, a lock pocket defined by said annular flange, said lock pocket being located a predetermined distance from said bowl liner mounting surface, and a lock mount defined by said annular flange, said lock mount being located a second predetermined distance from said bowl liner mounting surface; and a bowl liner locking assembly for fixing either the first bowl liner or the second bowl liner to said bowl, said locking assembly including a wedge member adapted to engage the locking flange of either the first bowl liner or the second bowl liner, a first link connected to said wedge member and having a mounting piece, said mounting piece being adapted to be received by either said lock pocket or said lock mount.

13. A cone crusher as set forth in claim 12 wherein said wedge member provides a locking surface engaging with said locking flange, and wherein said first link has an adjustable length.

14. A cone crusher according to claim 12, wherein said first link is pivotable with respect to said bowl.

15. A cone crusher according to claim 12, further comprising a second link connected to said wedge member and engageable with said bowl.

16. A cone crusher according to claim 15, wherein said second link has an adjustable length.

17. A cone crusher according to claim 15, wherein said second link is pivotable with respect to said bowl.

18. A cone crusher adapted to be alternatively operable with either a first bowl liner or a second bowl liner, the first and second bowl liners each having an inlet end and a locking flange extending from the inlet end, and a bowl mounting surface, the first bowl liner having a first predetermined length extending between its inlet end and its bowl mounting surface, the second bowl liner having a second predetermined length extending between its inlet end and its bowl mounting surface, said crusher comprising:

a bowl assembly including a bowl having a bowl liner mounting surface, a cylindrical wall and an annular flange extending from said cylindrical wall;

locking means for alternatively fixing the first bowl liner and the second bowl liner to said bowl; and a feed cone adapter fixed to the bowl and sealing engaging with the inlet end of either the first bowl liner or the second bowl liner.

19. A cone crusher according to claim 18, wherein said feed cone adapter is alternatively orientated in a first position when sealing engaging the first bowl liner and in a second position when sealing engaging the second bowl liner.

20. A cone crusher according to claim 19, wherein said feed cone adapter includes an elongated tube having opposite ends and a flange extending radially from the tube wherein said flange is located intermediate said opposite ends so that said ends are unequally spaced from the flange.

* * * * *